US012747903B2

(12) United States Patent
Platts et al.

(10) Patent No.: US 12,747,903 B2
(45) Date of Patent: Sep. 29, 2026

(54) NUGGET ICE ROTATABLE HOLDER ASSEMBLY

(71) Applicant: Haier US Appliance Solutions, Inc., Wilmington, DE (US)

(72) Inventors: Lauren Nicole Platts, Louisville, KY (US); Alan Joseph Mitchell, Louisville, KY (US); Minjoo Han, Louisville, KY (US); Alexander Marovec, South Haven, MI (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 98 days.

(21) Appl. No.: 18/897,437

(22) Filed: Sep. 26, 2024

(65) Prior Publication Data

US 2026/0139889 A1 May 21, 2026

(51) Int. Cl.

| | |
|---|---|
| ***F25C 5/20*** | (2018.01) |
| ***A45D 40/04*** | (2006.01) |
| ***A45D 40/06*** | (2006.01) |

(52) U.S. Cl.

CPC ..... *F25C 5/20* (2018.01); *A45D 40/04* (2013.01); *A45D 40/06* (2013.01); *F25C 2305/00* (2013.01)

(58) Field of Classification Search

CPC .... F25C 2305/00; F25C 5/20; F25C 2400/00; F25C 2400/04; A45D 40/02; A45D 40/04; A45D 40/06; A45D 2040/208

USPC ..... 222/1; 401/77, 78

See application file for complete search history.

(56) References Cited

U.S. PATENT DOCUMENTS

| | | | | | |
|---|---|---|---|---|---|
| 3,083,823 | A * | 4/1963 | Metreaud | A45D 40/06 | 401/86 |
| 4,514,102 | A * | 4/1985 | Ackerman | A45D 40/06 | 401/98 |
| 5,531,318 | A * | 7/1996 | Coleman | A45D 40/023 | 401/59 |
| 6,136,352 | A * | 10/2000 | Silverstein | A45D 40/10 | 426/115 |
| 2006/0193676 | A1* | 8/2006 | Gordon | A23G 3/563 | 401/55 |

FOREIGN PATENT DOCUMENTS

| | | |
|---|---|---|
| CN | 2399686 Y | 10/2000 |
| CN | 202635509 U | 1/2013 |
| CN | 203505471 U | 4/2014 |
| CN | 205957567 U | 2/2017 |

* cited by examiner

*Primary Examiner* — David J Walczak
(74) *Attorney, Agent, or Firm* — Dority & Manning, P.A.

(57) ABSTRACT

A holding assembly for frozen edible solids includes an outer cylinder with a spiral groove defined on an inner surface of the outer cylinder. The holding assembly also includes an inner cylinder positioned within the outer cylinder. The inner cylinder defines a slot extending in the axial direction. The holding assembly further includes a platform positioned within the inner cylinder. The platform is translatable along the axial direction within the inner cylinder. The holding assembly also includes a grip positioned at the outer cylinder. The grip is configured to rotate the inner cylinder within the outer cylinder. A method of operating the holding assembly includes rotating the grip of the holding assembly, translating the platform within the inner cylinder, and lifting frozen edible solids in the axial direction out of the outer cylinder.

18 Claims, 6 Drawing Sheets

NUGGET ICE ROTATABLE HOLDER ASSEMBLY

FIELD OF THE INVENTION

The present subject matter relates generally to assemblies for holding nugget ice, and more specifically to rotatable nugget ice holding assemblies.

BACKGROUND OF THE INVENTION

Ice makers generally produce ice for use by consumers, such as in beverages, for cooling food items, etc. Certain refrigerator appliances include ice makers for producing ice. The ice maker can be positioned within the appliance's freezer chamber and direct ice into an ice bucket where the ice is stored within the freezer chamber. Such refrigerator appliances can also include a dispensing system for assisting a user with accessing ice produced by the refrigerator appliance's ice maker. Stand-alone ice makers may be separate from refrigerator appliances and provide independent ice supplies. Generally, liquid water is added to the stand-alone ice makers, and the ice makers operate to freeze the liquid water and form ice.

Stand-alone ice makers may generally be configured to provide nugget ice. Typically, nugget ice is one general size and shape and is soft textured when compared to the common ice cube. Additionally, nugget ice typically has a melting rate higher than the common ice cube, as well as a lower-density composition, such that the chewing force compared to the common ice cube may be reduced. As such, it is typical for users to snack, or chew, on nugget ice.

Accordingly, a portable holder or accessory to hold nugget ice on-demand and carry it may be desirable. In particular, a handheld, portable way to hold and snack on nugget ice may be desirable.

BRIEF DESCRIPTION OF THE INVENTION

Aspects and advantages of the invention will be set forth in part in the following description, or may be apparent from the description, or may be learned through practice of the invention.

In one example embodiment, a method of operating a holding assembly for frozen edible solids is provided. The holding assembly defines an axial direction, a radial direction, and a circumferential direction. The holding assembly includes an outer cylinder with a spiral groove defined on an inner surface of the outer cylinder. The holding assembly also includes an inner cylinder positioned within the outer cylinder. The inner cylinder defines a slot extending in the axial direction. The holding assembly further includes a platform positioned within the inner cylinder. The platform is translatable along the axial direction within the inner cylinder. The holding assembly also includes a grip positioned at the outer cylinder. The grip is configured to rotate the inner cylinder within the outer cylinder. The method includes rotating the grip of the holding assembly, translating the platform within the inner cylinder, and lifting frozen edible solids in the axial direction out of the outer cylinder.

In another example embodiment, a holding assembly for frozen edible solids is provided. The holding assembly defines an axial direction, a radial direction, and a circumferential direction. The holding assembly includes an outer cylinder with a spiral groove defined on an inner surface of the outer cylinder. The holding assembly also includes an inner cylinder positioned within the outer cylinder. The inner cylinder defines a slot extending in the axial direction. The holding assembly further includes a platform positioned within the inner cylinder. The platform is translatable along the axial direction within the inner cylinder. The holding assembly also includes a grip positioned at the outer cylinder. The grip is configured to rotate the inner cylinder within the outer cylinder.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
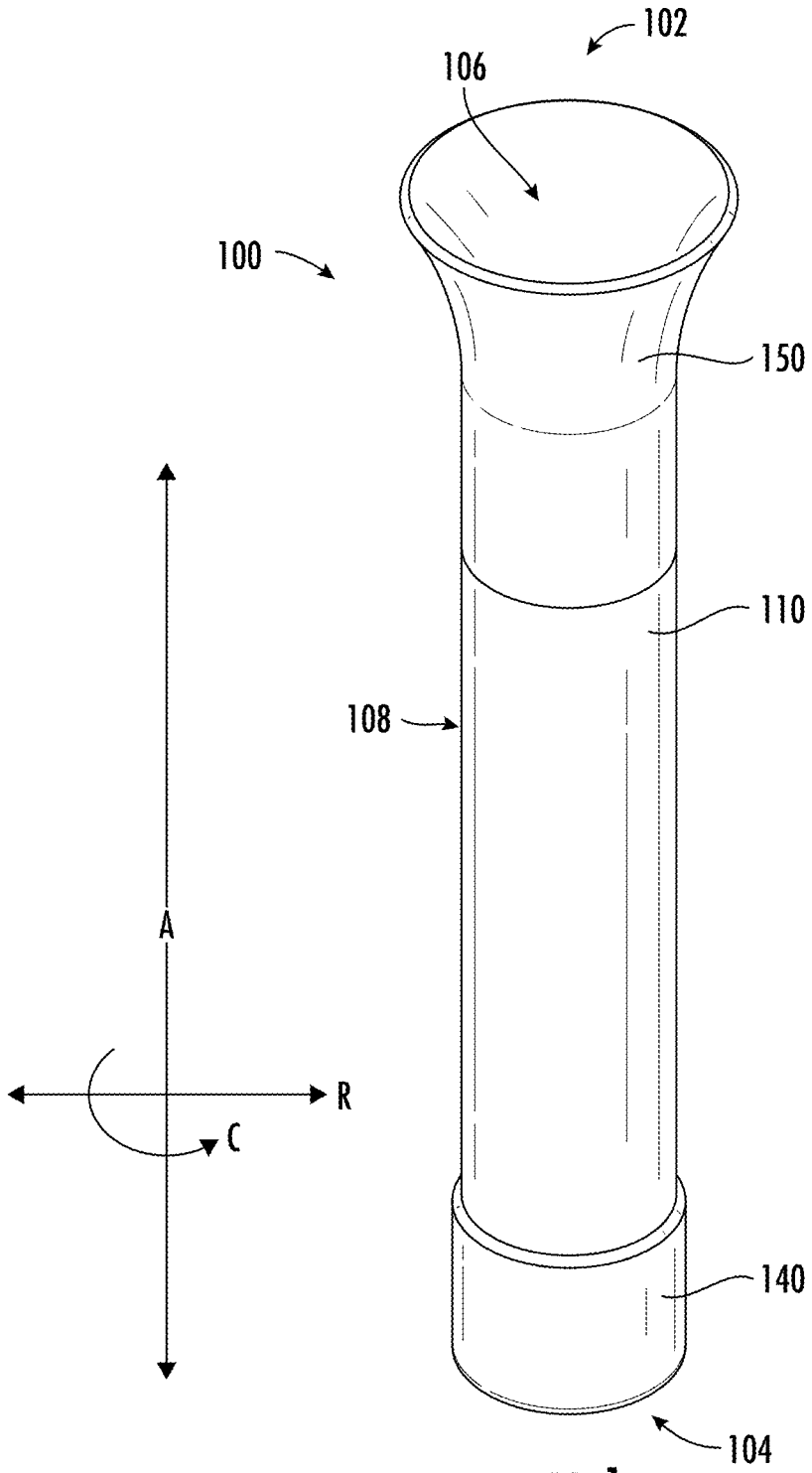
FIG. 1 provides a perspective view of an example frozen edible solid holding assembly according to aspects of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. Moreover, the word "example" is used herein to mean "serving as an example, instance, or illustration." In addition, references to "an embodiment" or "one embodiment" does not necessarily refer to the same embodiment, although it may. Any implementation described herein as "example" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "include(s)" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

As one skilled in the art will appreciate, the below described embodiments are used only for the purpose of explanation. Modifications and variations may be applied, other configurations may be used, and the resulting configurations may remain within the scope of the invention.

Generally, the present disclosure may include a holding assembly for frozen edible solids, such as a popsicle. The holding assembly may include an outer cylinder defining a spiral groove on an inner surface of the outer cylinder. The holding assembly may also include an inner cylinder positioned within the outer cylinder. The inner cylinder may define a slot. The holding assembly may further include a platform positioned within the inner cylinder. The platform may be translatable within the inner cylinder. Additionally, holding assembly may include a grip positioned at the outer cylinder. The grip may be configured to rotate the inner cylinder within the outer cylinder. Additionally or alternatively, the present disclosure may include a method of operating such a holding assembly. The method may include rotating the grip of the holding assembly, translating the platform within the inner cylinder, and lifting frozen edible solids out of the outer cylinder.

Turning now to the figures, FIG. 1 provides a perspective view of a holding assembly 100. In general, holding assembly 100 may define an axial direction A, a radial direction R, and a circumferential direction C. In particular, the axial direction A may be perpendicular to the radial direction R, and the circumferential direction C may be a curved or circular direction in a plane defined by the radial direction R, e.g., circumferential direction C may be generally perpendicular to axial direction A. In general, holding assembly 100 may be a cylindrically shaped tube 108 extending between a top side 102 and a bottom side 104 in the axial direction A. In particular, one example embodiment of holding assembly 100 may include an outer cylinder 110 with a funnel 150 positioned at top side 102 and a grip 140 positioned at bottom side 104.

In general, holding assembly 100 may receive ice, such as nugget/snack ice, through an opening 106 at top side 102 of holding assembly 100. In general, funnel 150 may be removably attached to outer cylinder 110, e.g., to facilitate the addition of ice to holding assembly 100 while attached and may be removed from outer cylinder 110 once complete. For example, a user may use funnel 150, while attached to outer cylinder 110 to scoop ice, such as from an ice bucket (not shown), directly into opening 106 in top side 102 of holding assembly 100. Additionally or alternatively, a user may scoop ice with a separate utensil, such as a spoon, scoop, etc., and dump/pour/place ice into opening 106 of holding assembly 100 (e.g., with or without funnel 150 attached to outer cylinder 110). In general, once the cylindrically shaped tube 108 of holding assembly 100 is filled with ice, a user may use a tamper (not shown), such as a rod or piston, to manually compress the ice within holding assembly 100. In some example embodiments, the tamper for holding assembly 100 may generally include a mechanical lever (not shown), whereby a user may rotate the lever to manually compress the ice within holding assembly 100.

For example, compressing the ice within holding assembly 100 may generally include crushing the ice and compact the ice together into a cylindrically shaped frozen edible solid, e.g., forming one or more of a popsicle, an ice block, an ice drop, an ice pop, and/or an ice lolly. Furthermore, before, during, or after compressing the ice within holding assembly 100, a user may add flavoring to the ice through opening 106. In general, holding assembly 100 may generally hold the resulting frozen edible solid within the cylindrically shaped tube 108, such as until a user operates holding assembly 100 to dispense the frozen edible solid from opening 106, as will be described in further detail hereinbelow.

Figure 2:
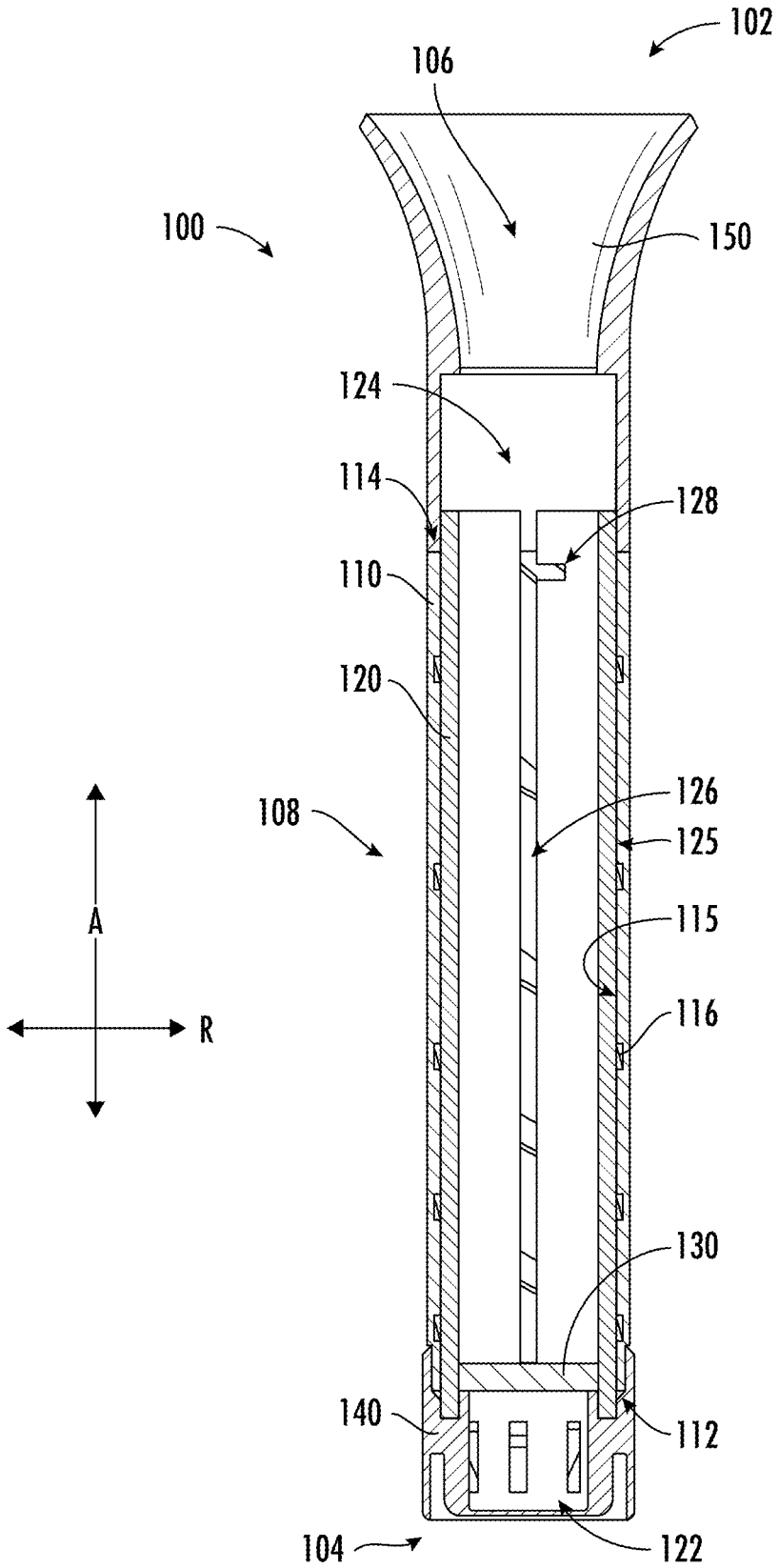
FIG. 2 provides a side, sectional view of the example frozen edible solid holding assembly of FIG. 1.

Turning now to FIG. 2, illustrated is a side, section view of holding assembly 100. In general, cylindrically shaped tube 108 between grip 140 and funnel 150 may include outer cylinder 110 and an inner cylinder 120. Accordingly, cylindrically shaped tube 108 may generally be a double-walled container, such that cylindrically shaped tube 108 may be thermally insulative to ice placed therein. In particular, outer cylinder 110 and inner cylinder 120 may be hollow, concentric cylinders. For example, inner cylinder 120 may position within outer cylinder 110 such that outer surface 125 of inner cylinder 120 is within three millimeters (3 mm), such as within two millimeters (2 mm), such as within one millimeter (1 mm) of inner surface 115 of outer cylinder 110.

As stated above, outer cylinder 110 and inner cylinder 120 may be hollow, concentric cylinders. As such, ice added to holding assembly 100 through opening 106 may generally be held within inner cylinder 120. In general, holding assembly 100 may include a platform 130 positioned within inner cylinder 120. For example, as shown in FIG. 2, platform 130 may be in a bottom position, e.g., platform 130 may be positioned proximate to bottom side 104 of holding assembly 100 (e.g., platform 130 may be positioned closer to bottom side 104 than top side 102 of holding assembly 100 while staying within inner cylinder 120). As will be explained in greater detail below, platform 130 may be translatable within inner cylinder 120 between the bottom position and a top position (FIG. 4).

In general, grip 140 may be positioned at bottom side 104 of holding assembly 100. In particular, grip 140 may be coupled to inner cylinder 120 at bottom side 104, such that rotating grip 140 rotates inner cylinder 120 within outer cylinder 110. In general, rotating grip 140, such as counterclockwise around the circumferential direction C, may translate platform 130 in the axial direction A. As such, translating platform 130 in the axial direction A, such as from the bottom position to the top position, may lift a frozen edible solid out through opening 106 at top side 102 of holding assembly 100, e.g., dispensing the frozen edible solid for the user to consume. The translation of platform 130 in the axial direction A will be described in further detail below.

Figure 3:
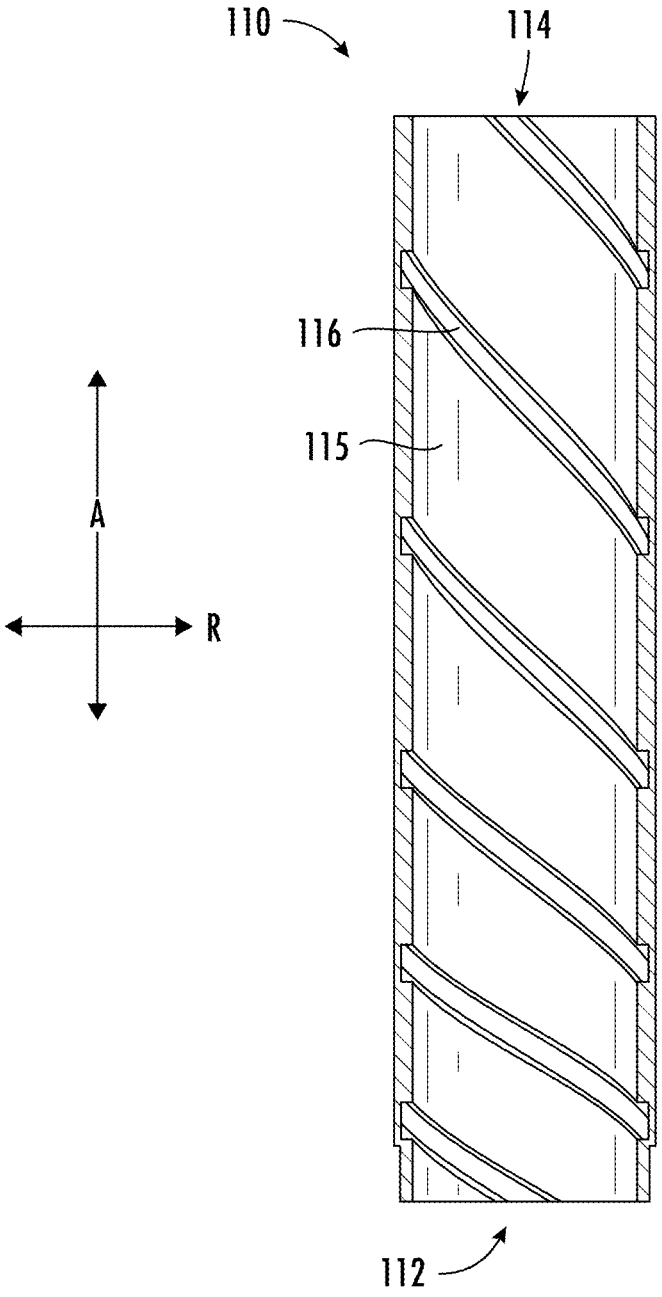
FIG. 3 provides a side, sectional view of an outer cylinder of the example frozen edible solid holding assembly of FIG. 1.

Referring now to FIG. 3, illustrated is a side, sectional view of outer cylinder 110. In general, outer cylinder 110 extends between a proximal end 112 and a distal end 114 in the axial direction A. In general, grip 140 (FIG. 2) may be positioned at proximal end 112 of outer cylinder 110. In general, outer cylinder 110 may define a spiral groove 116 on inner surface 115 of outer cylinder 110. In particular, spiral groove 116 may extend around inner surface 115 of outer cylinder 110 in the circumferential direction C between proximal end 112 and distal end 114 of outer cylinder 110. For example, spiral groove 116 may extend in the radial direction R into inner surface 115 of outer cylinder 110 (e.g., forming the groove) and may wrap around inner surface 115 of outer cylinder 110 in the circumferential direction C (e.g., 360° or more around inner surface 115 of outer cylinder 110), while extending in the axial direction A, such that spiral groove 116 forms a helical, or corkscrew, shape within inner surface 115 of outer cylinder 110. In general, spiral groove 116 may be a single groove, or spiral groove 116 may be a pair of spiral grooves 116 in inner surface 115 of outer cylinder 110. In particular, the pair of spiral grooves 116 may be positioned such that the pair of grooves form a double helix shape within inner surface 115 of outer cylinder 110, e.g., the pair of grooves may run generally parallel on opposing sides (not shown) of outer cylinder 110, with respect to the radial direction R.

Figure 4:
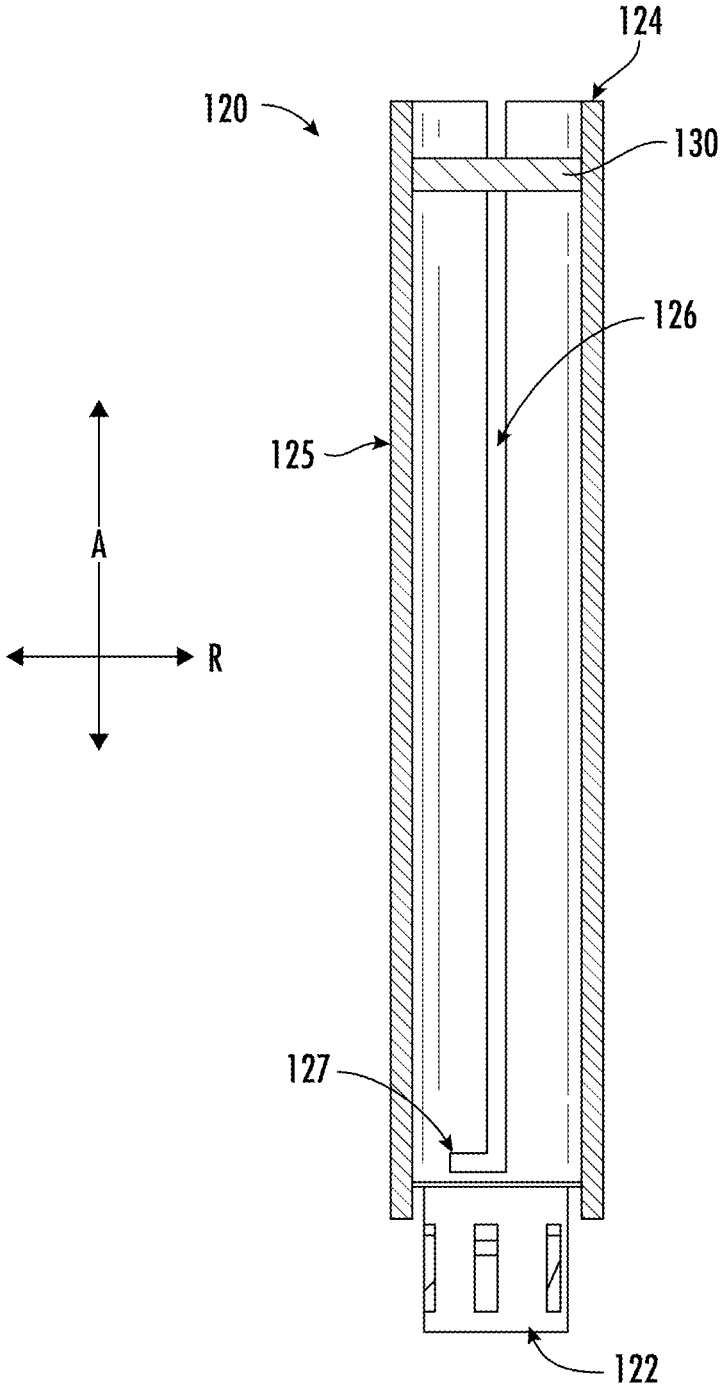
FIG. 4 provides a side, sectional view of an inner cylinder of the example frozen edible solid holding assembly of FIG. 1.

Turning briefly now to FIG. 4, illustrated is a side, sectional view of inner cylinder 120. In general, inner cylinder 120 may extend between a proximal end 122 and a distal end 124 in the axial direction A. In general, inner cylinder 120 defines a slot 126 extending in the axial direction A. In particular, slot 126 may extend in the axial direction A between proximal end 122 and distal end 124 of inner cylinder 120. In general, slot 126 may be a single slot, or slot 126 may be a pair of slots 126 running parallel on opposing sides (not shown) of inner cylinder 120, with respect to the radial direction R. In general, inner cylinder 120 may be any suitable material for holding ice, such as metal. In particular, a metal inner cylinder 120 may provide reduced friction between inner cylinder 120 and platform 130, when compared to other materials such as plastic.

Referring generally to FIGS. 2 and 4, grip 140 may generally be coupled to inner cylinder 120 at proximal end 122 of inner cylinder 120. As such, grip 140 may rotate inner cylinder 120, thereby rotating slot 126 around the circumferential direction C. In general, slot 126 may define a first notch 127 (FIG. 4) proximate proximal end 122 of inner cylinder 120 (e.g., closer to proximal end 122 than to distal end 124) and a second notch 128 (FIG. 2) positioned proximate distal end 124 of the inner cylinder (e.g., closer to distal end 124 than to proximal end 122). As stated above, platform 130 may be translatable within inner cylinder 120 between the bottom position (FIG. 2) and the top position (FIG. 4). In other words, translating platform 130 within inner cylinder 120 includes translating platform 130 in the axial direction A between proximal end 122 and distal end 124 of inner cylinder 120. In particular, first notch 127 may secure platform 130 into the bottom position (e.g., proximate proximal end 122), and second notch 128 may secure platform 130 into the top position (e.g., proximate distal end 124), as will be described further below.

Figure 5:
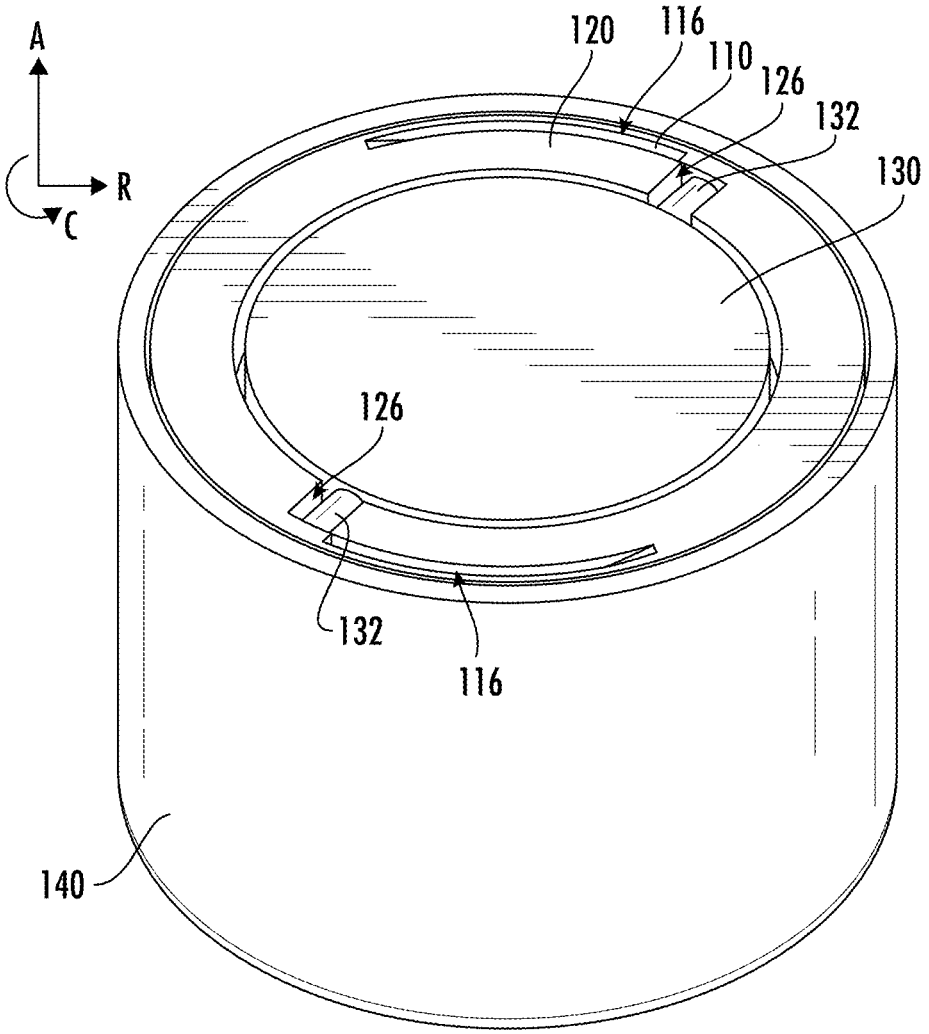
FIG. 5 provides a perspective, sectional view of a platform of the example frozen edible solid holding assembly of FIG. 1.

Referring briefly now to FIG. 5, illustrated is a perspective, sectional view of platform 130 within inner cylinder 120. In general, platform 130 may include a tab 132 extending in the radial direction R, e.g., tab 132 may be a pair of tabs 132 extending from opposing sides (not labeled) of platform 130 with respect to the radial direction R. In particular, tab 132 may extend from platform 130 through slot 126 of inner cylinder 120 and into spiral groove 116 of outer cylinder 110. In general, tab 132 may engage both spiral groove 116 and slot 126 when translating in the axial direction through inner cylinder 120, as will be explained below.

Figure 6:
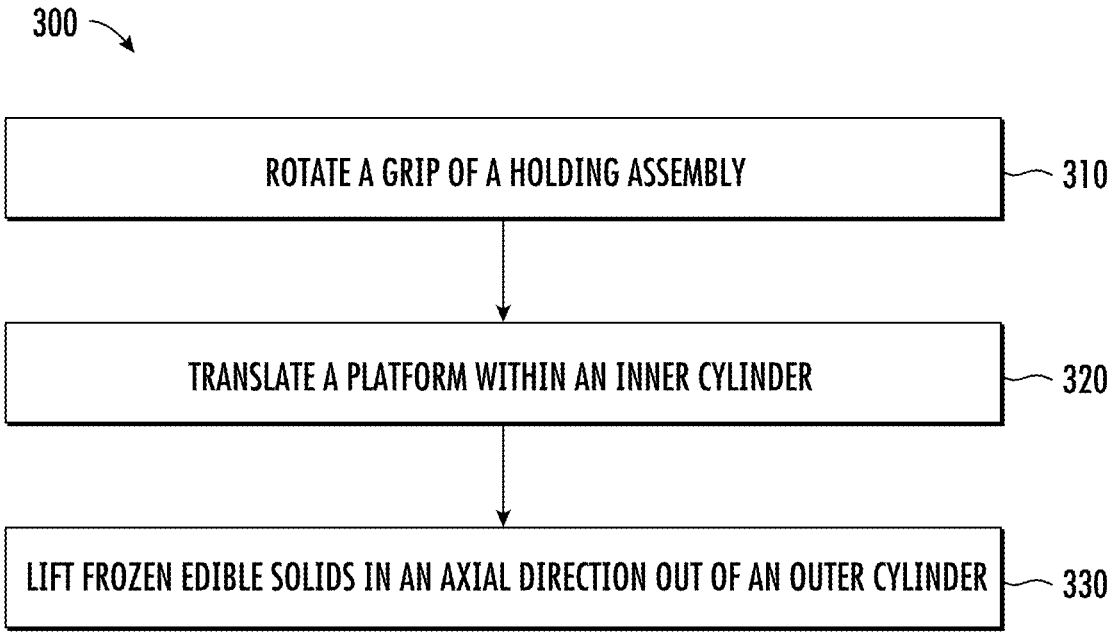
FIG. 6 provides a flowchart of an example method of operating a frozen edible solid holding assembly according to aspects of the present disclosure.

Referring now to FIG. 6, a flow diagram of one embodiment of a method 300 of operating a holding assembly for frozen edible solids is illustrated in accordance with aspects of the present subject matter. In general, method 300 will be described herein with reference to the embodiments of holding assembly 100 and related elements described above with reference to FIGS. 1-5. However, it should be appreciated by those of ordinary skill in the art that the disclosed method 300 may generally be utilized in association with apparatuses and systems having any other suitable configuration. One skilled in the art, using the disclosures provided herein, will appreciate that various steps of the method disclosed herein can be omitted, rearranged, combined, and/or adapted in various ways without deviating from the scope of the present disclosure.

As shown in FIG. 6, at (310), method 300 may generally include rotating grip 140 of holding assembly 100. As stated above, grip 140 may generally be coupled to inner cylinder 120 at proximal end 122 of inner cylinder 120. In particular, rotating grip 140 at bottom side 104 of holding assembly 100 may rotate inner cylinder 120 within outer cylinder 110, thereby rotating slot 126 around the circumferential direction C within outer cylinder 110.

At (320), method 300 may generally include translating platform 130 within inner cylinder 120. As stated above, platform 130 may include tab 132 extending radially, in the radial direction R, from platform 130 through slot 126 of inner cylinder 120 and into spiral groove 116 of outer cylinder 110. In particular, translating platform 130 within inner cylinder 120 may include tab 132 engaging with slot 126, as slot 126 (e.g., inner cylinder 120) is rotated around the circumferential direction C, such that tab 132 rotates, clockwise or counterclockwise, in the circumferential direction C with slot 126. Further, tab 132 also engages with spiral groove 116, thereby translating platform 130 in the axial direction A through slot 126, as tab 132 follows spiral groove 116 around the circumferential direction C and axial direction A.

For example, when platform 130 is at the bottom position (FIG. 2), rotating grip 140 counterclockwise around the circumferential direction C may engage tab 132 of platform 130 within spiral groove 116 and slot 126 to raise platform 130 in the axial direction A from the bottom position towards the top position (FIG. 4). Furthermore, upon reaching the top position, tab 132 may engage within second notch 128, thus immobilizing platform 130 from traveling further in the axial direction A. Accordingly, method 300 may further include immobilizing platform 130 within one of first notch 127 or second notch 128 when platform translates to either respective first notch 127 or second notch 128 within inner cylinder 120. As such, first notch 127 may define the bottom position of platform 130 and second notch 128 may define the top position of platform 130, as platform 130 may not surpass first notch 127 when being lowered (in the axial direction A) through inner cylinder 120 and platform 130 may not surpass second notch 128 when being raised (in the axial direction A) through inner cylinder 120.

For example, rotating grip 140 clockwise around the circumferential direction C may engage tabs 132 of platform 130 within spiral groove 116 and slot 126 to lower platform 130 in the axial direction A to the bottom position. Upon reaching first notch 127, tab 132 of platform 130 may engage within first notch 127 immobilizing platform 130 from traveling further in the axial direction A when grip 140 is rotated in the clockwise direction around the circumferential direction C. Platform 130 may generally be mobilized again by rotating grip 140 in the opposite direction, such as counterclockwise in the present example, thus translating tab 132 out of first notch 127 and into slot 126.

At (330), method 300 may generally include lifting frozen edible solids, in the axial direction A, out of outer cylinder 110. For example, ice may be added to holding assembly 100 while platform 130 is in the bottom position. After crushing/compact the ice into a cylindrically shaped frozen edible solid within holding assembly 100, a user my lift the frozen edible solid with platform 130 from within inner cylinder 120. As such, a user may selectively dispense ice from opening 106, and thus out of outer cylinder 110. In particular, platform 130 may lift the frozen edible solid as platform 130 translates in the axial direction A. As such, a user may carry and dispense the frozen edible solid as desired from holding assembly 100, thus enhancing the snacking experience of nugget/snack ice.

While described above with respect to the illustrated embodiment of holding assembly 100 in FIGS. 1 through 5, one of skill in the art would understand holding assembly 100 may be configured in any suitable configuration for holding and dispensing frozen edible solids, e.g., in additional or alternative embodiments, platform 130 of holding assembly 100 may generally be pushed upwards from bottom side 104 of holding assembly 100. For example, a user may use a finger, a rod (not shown), or any other suitable tool to push platform 130 up in the axial direction A through the cylindrically shaped tube 108 to dispense frozen edible solids.

As may be seen from the above, a portable accessory for making ice popsicles is provided. The assembly may be a double-walled insulated tube that the user may fill with ice and compress the ice with a tamper. The tube has a vertical channel on an inner cylinder, and a twisting channel on an outer cylinder. A platform may rotate up and down by following both channels. As such, the bottom portion (e.g., a grip) of the assembly may be rotated to twist and raise the compacted ice within the cylinder.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a holding assembly for frozen edible solids, the holding assembly defining an axial direction, a radial direction, and a circumferential direction, the holding assembly comprising an outer cylinder defining a spiral groove on an inner surface of the outer cylinder, an inner cylinder positioned within the outer cylinder, the inner cylinder defining a slot extending in the axial direction, a funnel removably coupled to the outer cylinder, a platform positioned within the inner cylinder, the platform translatable along the axial direction within the inner cylinder, and a grip positioned at the outer cylinder, the grip configured to rotate the inner cylinder within the outer cylinder, the method comprising:

rotating the grip of the holding assembly;

translating the platform within the inner cylinder; and lifting frozen edible solids in the axial direction out of the outer cylinder.

2. The method of claim 1, wherein the outer cylinder extends between a proximal end and a distal end, the spiral groove extending around the circumferential direction between the proximal end and the distal end of the outer cylinder.

3. The method of claim 1, wherein the inner cylinder extends between a proximal end and a distal end, wherein the slot extending in the axial direction extends between the proximal end and the distal end of the inner cylinder.

4. The method of claim 3, wherein the grip is coupled to the inner cylinder at the proximal end of the inner cylinder, wherein rotating the grip of the holding assembly comprises rotating the inner cylinder within the outer cylinder.

5. The method of claim 3, wherein translating the platform within the inner cylinder comprises translating the platform in the axial direction between the proximal end and the distal end of the inner cylinder.

6. The method of claim 3, wherein the slot of the inner cylinder defines a first notch proximate the proximal end of the inner cylinder and a second notch positioned proximate the distal end of the inner cylinder, the method further comprising immobilizing the platform within one of the first notch or the second notch when the platform translates to either respectively the first notch or the second notch within the inner cylinder.

7. The method of claim 1, wherein the platform comprises a tab extending in the radial direction through the slot of the inner cylinder and into the spiral groove of the outer cylinder, whereby the tab engages both the spiral groove and the slot when rotating the grip of the holding assembly.

8. The method of claim 1, wherein the inner cylinder is metal.

9. The method of claim 1, wherein the outer cylinder and the inner cylinder comprise hollow, concentric cylinders.

10. A holding assembly for frozen edible solids, the holding assembly defining an axial direction, a radial direction, and a circumferential direction, the holding assembly comprising:

an outer cylinder defining a spiral groove on an inner surface of the outer cylinder;

an inner cylinder positioned within the outer cylinder, the inner cylinder defining a slot extending in the axial direction;

a funnel removably coupled to the outer cylinder;

a platform positioned within the inner cylinder, the platform translatable along the axial direction within the inner cylinder; and a grip positioned at the outer cylinder, the grip configured to rotate the inner cylinder within the outer cylinder.

11. The holding assembly of claim 10, wherein the outer cylinder extends between a proximal end and a distal end, the spiral groove extending around the circumferential direction between the proximal end and the distal end of the outer cylinder.

12. The holding assembly of claim 10, wherein the inner cylinder extends between a proximal end and a distal end, wherein the slot extending in the axial direction extends between the proximal end and the distal end of the inner cylinder.

13. The holding assembly of claim 12, wherein the grip is coupled to the inner cylinder at the proximal end of the inner cylinder.

14. The holding assembly of claim 12, wherein rotating the grip translates the platform in the axial direction between the proximal end and the distal end of the inner cylinder.

15. The holding assembly of claim 12, wherein the slot of the inner cylinder defines a first notch proximate the proximal end of the inner cylinder and a second notch positioned proximate the distal end of the inner cylinder.

16. The holding assembly of claim 10, wherein the platform comprises a tab extending in the radial direction through the slot of the inner cylinder and into the spiral groove of the outer cylinder, whereby the tab engages both the spiral groove and the slot when the grip is rotated.

17. The holding assembly of claim 10, wherein the inner cylinder is metal.

18. The holding assembly of claim 10, wherein the outer cylinder and the inner cylinder comprise hollow, concentric cylinders.

* * * * *